US007553128B2

(12) United States Patent
Abdel-Messeh et al.

(10) Patent No.: US 7,553,128 B2
(45) Date of Patent: Jun. 30, 2009

(54) BLADE OUTER AIR SEALS

(75) Inventors: William Abdel-Messeh, Middletown, CT (US); Jesse R. Christophel, Manchester, CT (US)

(73) Assignee: United Technologies Corporation, Hartford, CT (US)

( * ) Notice: Subject to any disclaimer, the term of this patent is extended or adjusted under 35 U.S.C. 154(b) by 442 days.

(21) Appl. No.: 11/580,171

(22) Filed: Oct. 12, 2006

(65) Prior Publication Data

US 2008/0089787 A1 Apr. 17, 2008

(51) Int. Cl.
*F01D 9/00* (2006.01)

(52) U.S. Cl. ..... 415/173.1; 415/116; 415/139; 415/213.1

(58) Field of Classification Search ..... 415/173.1, 415/173.4, 174.4, 139, 178, 213.1
See application file for complete search history.

(56) References Cited

U.S. PATENT DOCUMENTS

| | | | | |
|---|---|---|---|---|
| 5,609,469 | A | 3/1997 | Worley et al. | |
| 5,797,726 | A * | 8/1998 | Lee | 416/96 R |
| 6,379,528 | B1 * | 4/2002 | Lee et al. | 205/640 |
| 6,393,331 | B1 | 5/2002 | Chetta et al. | |
| 6,957,949 | B2 * | 10/2005 | Hyde et al. | 416/97 R |
| 7,033,138 | B2 * | 4/2006 | Tomita et al. | 415/139 |
| 7,306,424 | B2 * | 12/2007 | Romanov et al. | 415/115 |
| 7,335,429 | B2 * | 2/2008 | Lee et al. | 428/680 |

* cited by examiner

*Primary Examiner*—Ninh H Nguyen
(74) *Attorney, Agent, or Firm*—Bachman & LaPointe, P.C.

(57) ABSTRACT

A blade outer air seal (BOAS) has a body having an inner (ID) face and an outer (OD) face, first and second circumferential ends, and fore and aft longitudinal ends. The BOAS has one or more mounting hooks extending from the body. The OD face comprises a plurality of transversely elongate protuberances. The protuberances include rearwardly divergent first protuberances and forwardly divergent second protuberances.

20 Claims, 6 Drawing Sheets

BLADE OUTER AIR SEALS

BACKGROUND OF THE INVENTION

The invention relates to gas turbine engines. More particularly, the invention relates to casting of cooled shrouds or blade outer air seals (BOAS).

BOAS segments may be internally cooled by bleed air. For example, cooling air may be fed into a plenum at the outboard (OD) side of the BOAS. The cooling air may pass through passageways in the seal body and exit outlet ports in the ID side of the body (e.g. to film cool the ID face). Air may also exit along the circumferential ends (matefaces) of the BOAS so as to be vented into the adjacent inter-segment region (e.g., to help cool feather seal segments sealing the adjacent BOAS segments).

The BOAS segments may be cast via an investment casting process. In an exemplary casting process, wax may be molded in a die to form a pattern. The pattern may be shelled (e.g., a stuccoing process to form a ceramic shell). The wax may be removed from the shell. Metal may be cast in the shell. The shell may be destructively removed. After shell removal, the passageways may be drilled. Alternatively, some or all of the passageways may be cast using a casting core.

SUMMARY OF THE INVENTION

One aspect of the invention involves a blade outer air seal (BOAS). The BOAS has a body having an inner (ID) face and an outer (OD) face, first and second circumferential ends, and fore and aft longitudinal ends. The BOAS has one or more mounting hooks extending from the body. The OD face comprises a plurality of transversely elongate protuberances. The protuberances include rearwardly divergent first protuberances and forwardly divergent second protuberances.

The details of one or more embodiments of the invention are set forth in the accompanying drawings and the description below. Other features, objects, and advantages of the invention will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
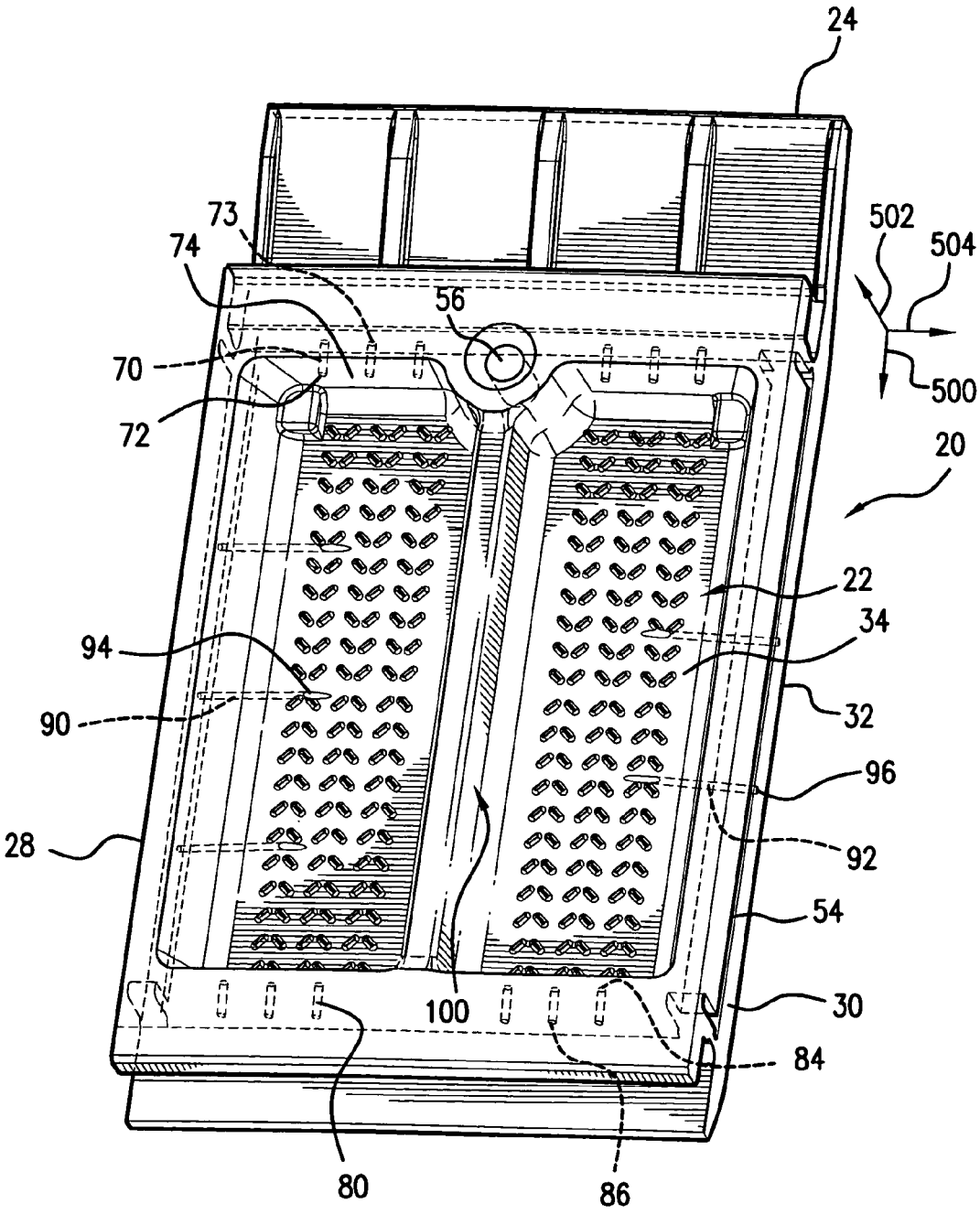
FIG. 1 is a view of a blade outer airseal (BOAS).

FIG. 1 shows blade outer air seal (BOAS) 20. The BOAS has a main body portion 22 having a leading/upstream/forward end 24 and a trailing/downstream/aft end 26. FIG. 1 further shows an approximate longitudinal/overall-downstream/aftward direction 500, an approximate radial outward direction 502, and an approximate circumferential direction 504. The body has first and second circumferential ends or matefaces 28 and 30. The body has an ID face 32 and an OD face 34.

To mount the BOAS to environmental structure 40 (FIG. 4), the exemplary BOAS has a plurality of mounting hooks. The exemplary BOAS has a single forward mounting hook 42 having a forwardly-projecting distal portion recessed aft of the forward end 24. The exemplary BOAS has a single aft hook 44 and 46 having a rearwardly-projecting distal portion slightly recessed from the aft end 26. The exemplary hook distal portions are formed as full width lips extending from a wall 46 circumscribing a chamber 48. A floor or base 50 of the chamber is locally formed by a central portion of the OD face 34.

Figure 4:
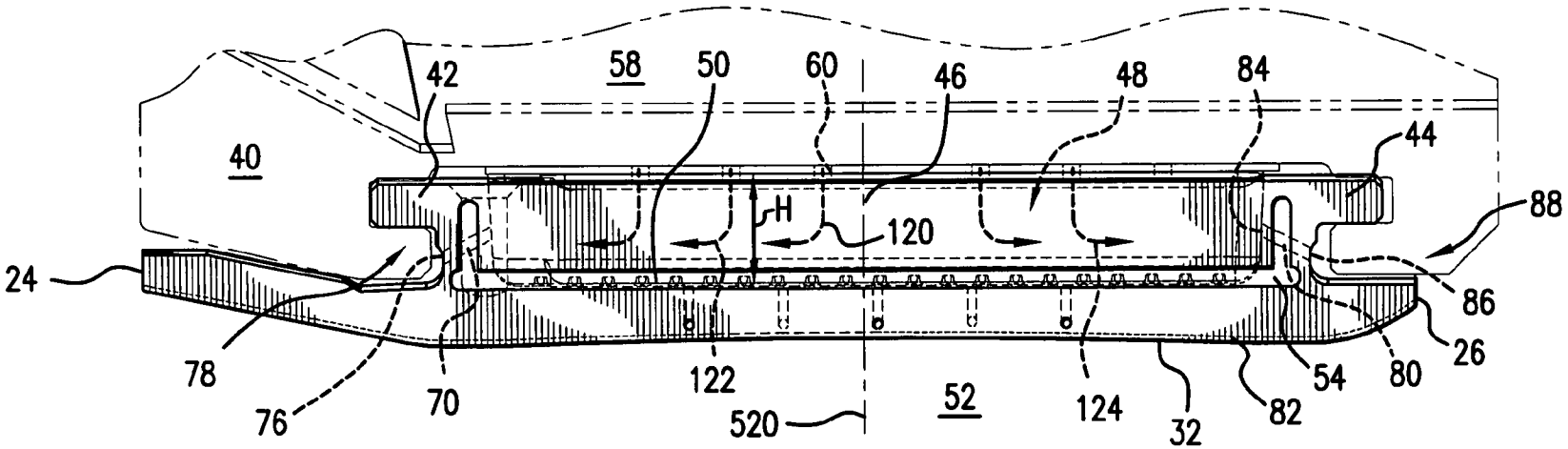
FIG. 4 is a first circumferential end view of the BOAS of FIG. 1.
Figure 5:
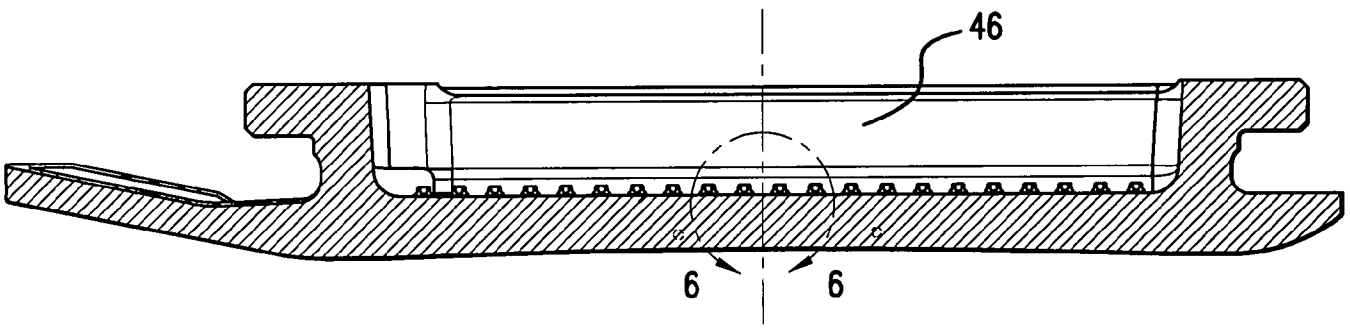
FIG. 5 is a longitudinal sectional of the BOAS of FIG. 1.

A circumferential ring array of a plurality of the BOAS 22 may encircle an associated blade stage of a gas turbine engine. The assembled ID faces 32 thus locally bound an outboard extreme of the core flowpath 52 (FIG. 4). The BOAS 22 may have features for interlocking the array. The exemplary matefaces 28 and 30 include slots 54 for accommodating edges of seals (not shown) spanning junctions between adjacent BOAS 22. FIG. 1 further shows a socket 56 for receiving a locator pin (not shown) locating the BOAS 22 relative to the environmental structure 40.

Figure 2:
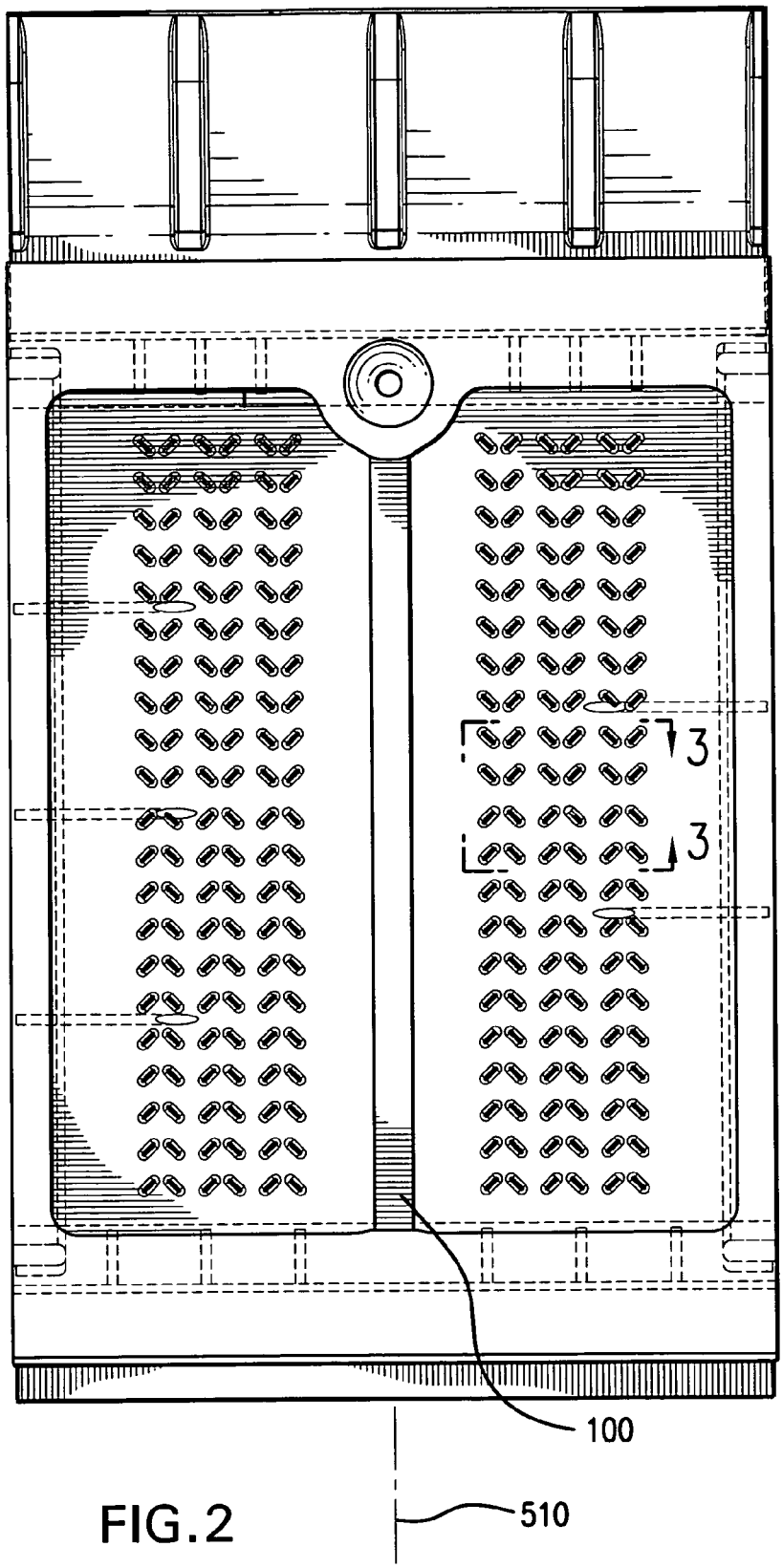
FIG. 2 is an OD/top view of the BOAS of FIG. 1.

The BOAS may be air-cooled. For example, bleed air may be directed to a chamber 58 (FIG. 4) immediately outboard of the plate 40. The bleed air may be directed through impingement holes 60 in the plate 40 to the chamber 48. An ex Air may exit the chamber 48 through discharge passageways. The exemplary BOAS of FIG. 1 shows exemplary leading passageways 70 extending from inlets 72 in a leading wall surface portion 74 of the wall 46. The exemplary passageways 70 are arranged in two groups of three on either side of a longitudinal/radial median plane 510 (FIG. 2). The exemplary passageways 70 have outlets 76 along the wall 46 at the base of a channel 78 formed by the hook 42. Similarly, trailing passageways 80 have inlets 82 in a trailing wall surface portions 84 and outlets 86 at a channel 88. Groups of first and second lateral passageways 90 and 92 extend respectively from inlets 94 along the surface 50 to outlets 96 on the adjacent matefaces. The central longitudinal dividing wall 100 extends upward from the floor 50 to divide the chamber 48 into first and second wells. The exemplary wall 100 is a partial height wall extending subflush to a rim of the wall 46 to structurally stiffen the BOAS.

FIG. 4 shows the airflows 120 passing through the holes 60. The presence of both leading passageways 70 and trailing passageways 80 causes a split in the flow with a first portion 122 flowing generally forward and a second portion 124 flowing generally rearward. A transverse plane 520 generally marks the split between these net flows.

Figure 3:
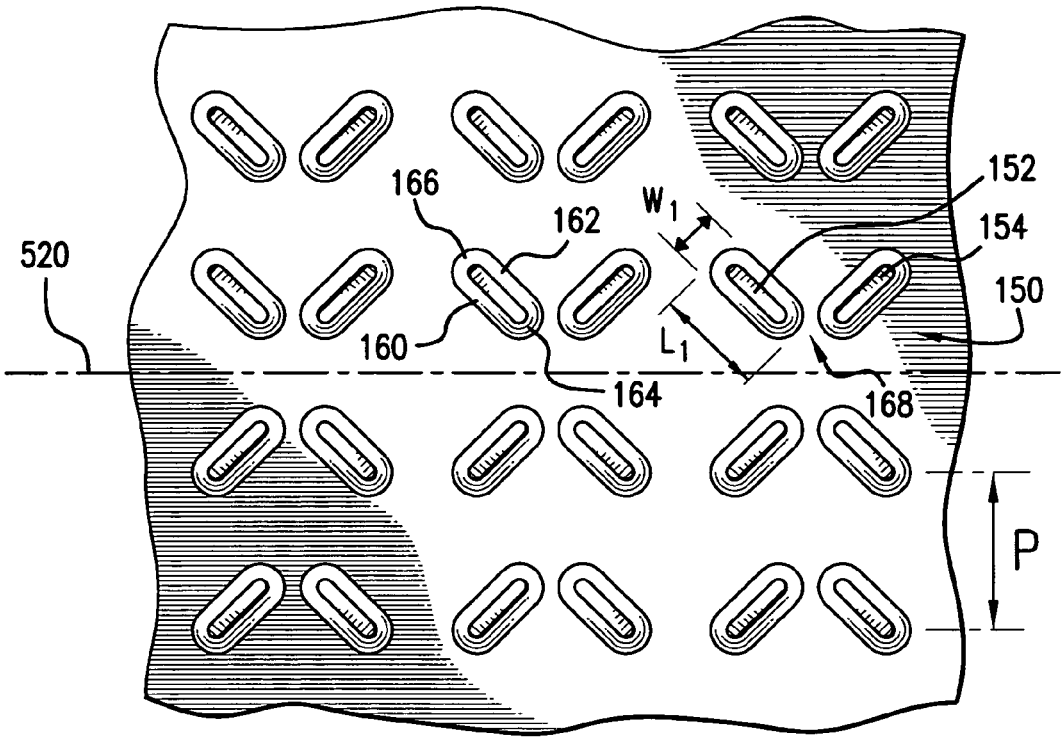
FIG. 3 is an enlarged view of a surface enhancement of the BOAS of FIG. 2.
Figure 6:
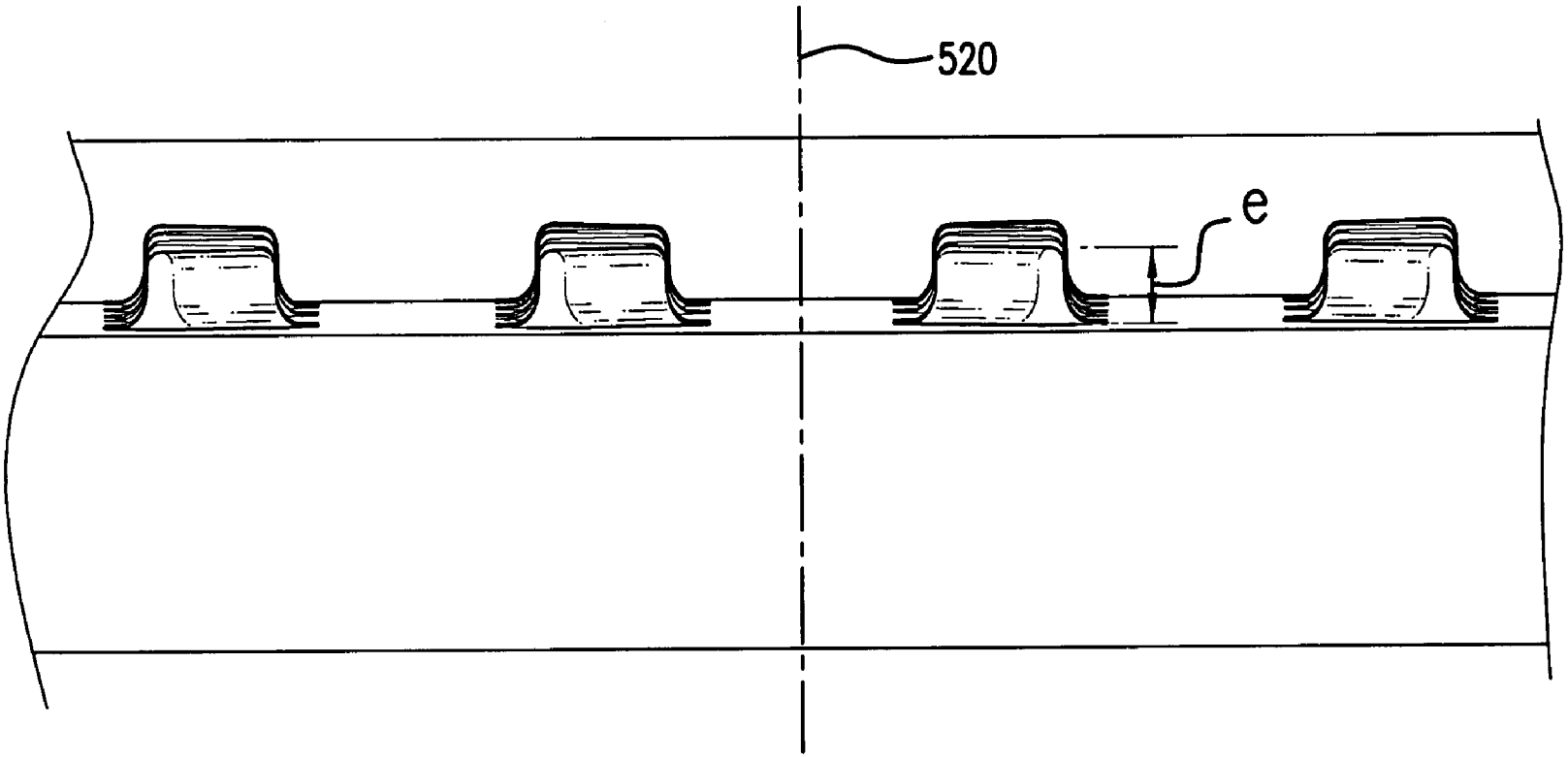
FIG. 6 is an enlarged view of the BOAS of FIG. 5.
Figure 7:
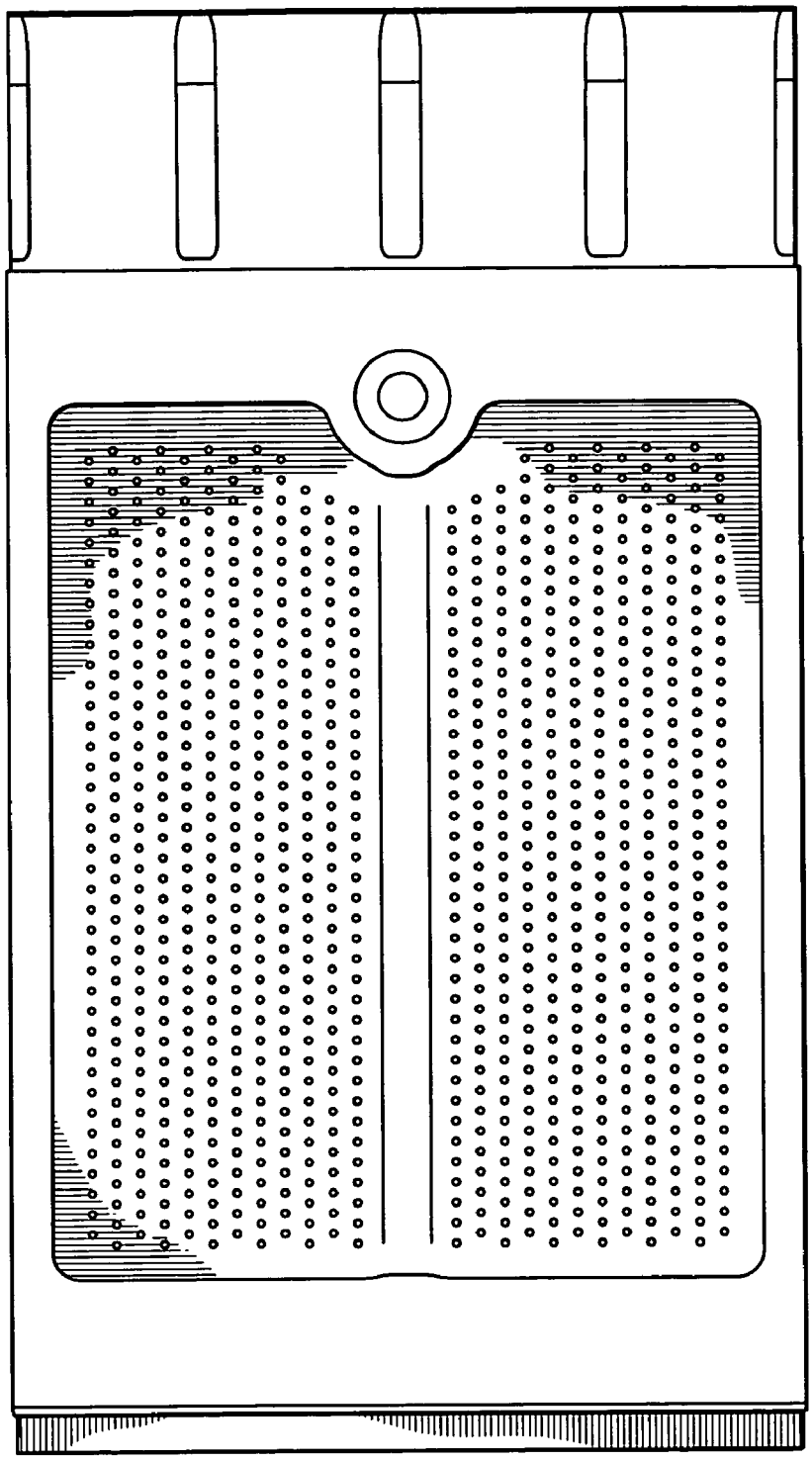
FIG. 7 PRIOR ART
FIG. 7 is an OD/top view of a prior art BOAS.

Surface enhancements are provided along the floor 50 to maximize heat transfer from the flows 122 and 124. Exemplary surface enhancements are broken or interrupted chevrons 150 (FIG. 3). Each chevron 150 includes first and second legs 152 and 154. Each leg 152 and 154 is elongate having a length $L_1$, a width $W_1$, and a height e (FIG. 6). Along the lengthwise dimension, each leg has a leading side or face 160 and a trailing side or face 162. Along the widthwise dimension, each leg has a leading end 164 and a trailing end 166. The leading ends 164 of each leg pair are separated by a gap 168 adjacent the omitted chevron apex. Omission of the chevron apex may result from castability considerations.

FIG. 3 shows the plane 520 as dividing the chevrons 150 into two subgroups. The legs (i.e., the side/faces 160 and 162 of each chevron 150) diverge away from the plane 520 (i.e., in a downstream direction of the associated flow 122 or 124). In a reengineering situation, the plane 520 may be positioned where the flows split. The wall 100 also divides the chevrons into two subgroups on either side of the wall 100. The wall

100 serves as a structural support to add rigidity to the BOAS. It also serves to divide the flow-path within the BOAS into two sections. Thus, the subgroups form four discrete subgroups/arrays. In the exemplary BOAS, each array is three chevrons wide, the two leading arrays are ten chevrons long, and the two trailing arrays are eleven chevrons long. The exemplary arrays are right arrays of constant longitudinal and transverse spacing.

The flow of air over the chevrons is directed such that the sub-layer of the boundary layer is tripped into the turbulent regime. The directional bias of the chevrons allows this tripped region to grow along the direction of the chevron trip strips thereby causing additional coolant (air) to be in contact with the surface such increases the heat transfer.

The spacing of the chevrons is set so that the coolant flow will be tripped over one chevron and have adequate spacing to re-attach to the floor 50 before the next chevron is reached. This separation and re-attachment is believed to allow the chevrons to provide superior heat transfer relative to closely spaced pin protuberances as in the prior art. The prior art may merely serve to increase the wetted surface area rather than fundamentally changing the mode of heat transfer obtained on the BOAS surface.

The BOAS is cooled by three methods: impingement cooling from holes 60, convective heat transfer cooling from the chevron trip strips 154, and film-cooling from holes 70, 80, 90, and 92. The convective heat transfer from the chevron trip strips is believed to be the dominant mode of cooling. For several reasons this is believed more effective than the prior art arrays of small pin-fins providing the backside cooling. First, the apex of the chevron is oriented in the direction of the flow on the right and left part of the BOAS surface (with flow toward cooling holes 70 and 80). This increases turbulence of the flow. Second, the chevron generates double vortices, which further increases the heat transfer coefficients along the cooled surface uniformly. Third, the height of the chevron is selected to be higher than the sub-layer of the boundary layer to ensure flow separation and re-attachment between two neighboring chevrons. This reattachment enhances the heat transfer coefficient. In an exemplary reengineering from a pin-fin enhancement configuration, these three factors are believed provide the BOAS with relatively uniform cooling with much higher heat transfer coefficients (e.g., an increase of more than 50%, more particularly in the vicinity of 80-110%).

The particular value for the height was chosen in conjunction with the directional spacing of the chevrons (pitch) to optimize the effectiveness of the chevrons and helps to give a uniform wall temperature. The final method of cooling for the part is the film-cooling, which cools the extreme ends of the BOAS. With this method of cooling, it is the BOAS is relatively uniformly cooled with low temperature gradient, which leads to low stress and strain and much improved service life.

Nominal parameters defining the chevron shape are referred to as P/e and e/H, where P is the linear spacing between two consecutive chevrons in the 500 direction, e is the height of the chevron and H is the distance between the impingement holes 60 (plate underside) and the floor 50.

Exemplary dimensions are: $3 \leqq P/e \leqq 50$, more narrowly $5 \leqq P/e \leqq 10$ or $5 \leqq P/e \leqq 15$; and $0.03 \leqq e/h \leqq 0.3$, more narrowly $0.05 \leqq e/h \leqq 0.10$. The height e may also reflect castability considerations. Exemplary e are 0.030+/−0.002 inch, more broadly 0.02-0.04 inch. In a reengineering situation, e will typically be greater (e.g., 10-50% greater) than a pin-fin height of the baseline part.

One or more embodiments of the present invention have been described. Nevertheless, it will be understood that various modifications may be made without departing from the spirit and scope of the invention. For example, when implemented in the reengineering of a baseline BOAS, or using existing manufacturing techniques and equipment, details of the baseline BOAS or existing techniques or equipment may influence details of any particular implementation. Accordingly, other embodiments are within the scope of the following claims.

What is claimed is:

1. A blade outer air seal comprising:

a body having an inner diameter (ID) face and an outer diameter (OD) face, first and second circumferential ends, fore and aft longitudinal ends and a plurality of cooling passageways; and one or more mounting hooks, wherein:

the OD face comprises a plurality of transversely elongate protuberances including, rearwardly divergent first protuberances and forwardly divergent second protuberances.

2. The seal of claim 1 wherein:

the protuberances have heights of 0.03+/−0.002 inch.

3. The seal of claim 1 wherein the cooling passageways include:

a leading plurality having inlets along a leading wall surface portion forward of the protuberances;

a trailing plurality having inlets along a trailing wall surface portion aft of the protuberances; and first and second lateral pluralities having inlets among the protuberances.

4. The seal of claim 1 wherein:

the protuberances are positioned in right arrays; and inlets of at least some the cooling passageways along the OD face are positioned among the protuberances.

5. The seal of claim 1 wherein:

the seal is formed of a nickel-based superalloy.

6. The seal of claim 5 wherein:

the seal has a coating.

7. The seal of claim 5 wherein:

the first protuberances have rearwardly divergent fore and aft faces; and the second protuberances have forwardly divergent fore and aft faces.

8. The seal of claim 1 wherein:

the first protuberances have rearwardly divergent fore and aft faces; and the second protuberances have forwardly divergent fore and aft faces.

9. The seal of claim 1 wherein:

the body has a perimeter wall and the protuberances are along a base of a compartment laterally surrounded by the perimeter wall.

10. The seal of claim 9 wherein:

the protuberances are positioned in four discrete right arrays.

11. The seal of claim 1 wherein:

the protuberances are positioned in four discrete right arrays.

12. A combination comprising:

a circumferential array of seals of claim 1; and blade stage with blade tips in facing proximity to the seal ID faces.

13. The combination of claim 12 wherein:

seal mounting hooks engage mating features of a support structure.

14. A blade outer air seal comprising:

a body having an inner diameter (ID) face and an outer diameter (OD) face, first and second circumferential ends, and fore and aft ends; and a pair of mounting hooks, wherein:

the OD face comprises a plurality of chevron or apex-less chevron planform protuberances; and the protuberances include a fore group of forwardly divergent protuberances and an aft group of rearwardly divergent protuberances.

15. The seal of claim 14 wherein:

a longitudinal dividing wall separates the protuberances into first and second circumferential groups.

16. The seal of claim 15 further comprising:

outlet passageways extending from inlets among the protuberances to outlets along the first and second circumferential ends.

17. A combination comprising:

seal of claim 16;

an impingement plate having an array of apertures; and an airflow through the apertures and then through the outlet passageways.

18. The combination of claim 17 wherein:

the airflow forms a forwardly-directed portion flowing over the fore group of protuberances and a rearwardly-directed portion flowing over the aft group of protuberances.

19. The combination of claim 17 wherein:

a ratio of height of the protuberances to a distance between an underside of the plate and a floor of the OD face is between 0.05 and 0.10, inclusive.

20. The seal of claim 14 further comprising:

outlet passageways extending from inlets among the protuberances to outlets along the first and second circumferential ends; and an impingement plate mounted to the body and having an array of apertures, the apertures positioned to allow an airflow through the apertures and then through the outlet passageways.

* * * * *

UNITED STATES PATENT AND TRADEMARK OFFICE

CERTIFICATE OF CORRECTION

PATENT NO. : 7,553,128 B2
APPLICATION NO. : 11/580171
DATED : June 30, 2009
INVENTOR(S) : William Abdel-Messeh et al.

It is certified that error appears in the above-identified patent and that said Letters Patent is hereby corrected as shown below:

In column 4, claim 2, line 26, delete "0.03" and insert --0.030--.

Signed and Sealed this

Twenty-second Day of December, 2009

David J. Kappos

David J. Kappos
*Director of the United States Patent and Trademark Office*